US009786427B2

(12) United States Patent
Xu et al.

(10) Patent No.: US 9,786,427 B2
(45) Date of Patent: Oct. 10, 2017

(54) COIL STRUCTURE OF OPEN VENTILATED TYPE STEREOSCOPIC WOUND-CORE DRY-TYPE TRANSFORMER

(71) Applicant: Haihong Electric Co., Ltd., Kaiping (CN)

(72) Inventors: Kaixuan Xu, Kaiping (CN); Xianqing Guo, Kaiping (CN); Qingning Liang, Kaiping (CN); Danju Song, Kaiping (CN)

(73) Assignee: Haihong Electric Co., Ltd., Kaiping (CN)

( * ) Notice: Subject to any disclaimer, the term of this patent is extended or adjusted under 35 U.S.C. 154(b) by 22 days.

(21) Appl. No.: 14/527,304

(22) Filed: Oct. 29, 2014

(65) Prior Publication Data

US 2016/0027573 A1 Jan. 28, 2016

(30) Foreign Application Priority Data

Jul. 25, 2014 (CN) ..... 2014 2 0417073 U

(51) Int. Cl.
*H01F 27/08* (2006.01)
*H01F 27/28* (2006.01)
(Continued)

(52) U.S. Cl.
CPC ..... *H01F 27/2871* (2013.01); *H01F 27/02* (2013.01); *H01F 27/08* (2013.01); *H01F 27/2823* (2013.01); *H01F 27/30* (2013.01); *H01F 27/306* (2013.01); *H01F 27/323* (2013.01); *H01F 27/325* (2013.01)

(58) Field of Classification Search
CPC ..... H01F 27/00–27/30
USPC ... 336/90, 96, 206–208, 170, 173, 180–184, 336/214–215, 55, 60, 62
See application file for complete search history.

(56) References Cited

U.S. PATENT DOCUMENTS 1,739,246 A * 12/1929 Majce ..... H01F 17/02 156/274.2
2,498,747 A * 2/1950 Wiegand ..... H01F 30/12 29/609

(Continued)

FOREIGN PATENT DOCUMENTS

CN 202976913 U * 6/2013

*Primary Examiner* — Tuyen Nguyen
(74) *Attorney, Agent, or Firm* — Honigman Miller Schwartz and Cohn LLP

(57) ABSTRACT

A coil structure of open ventilated type stereoscopic wound-core dry-type transformer, comprising wire disks formed by wound wires and fixing parts. The fixing parts are provided with clamping grooves for fixing the wire disks. The wire disks are fixed and wound around the fixing parts to form the coil structure. The outer layers of the wires are coated with insulating paper with insulating paint. And by insulating paint, wires are adhered mutually and wire disks adhere to fixing parts, which combine into an integral structure. The coil structure does not require another paint impregnation process, so the process is simplified. And by the insulating paint on the insulating paper, wires are adhered mutually and wire disks adhere to fixing parts, so the structure is stable and firm and ensures the electrical equipment meets the requirements of electric performance, mechanical property and insulating property.

1 Claim, 2 Drawing Sheets

(51) Int. Cl.

| | |
|---|---|
| ***H01F 27/30*** | (2006.01) |
| ***H01F 27/02*** | (2006.01) |
| ***H01F 27/32*** | (2006.01) |

(56) References Cited

U.S. PATENT DOCUMENTS

| | | | | | |
|---|---|---|---|---|---|
| 2,544,871 | A * | 3/1951 | Wiegand | H01F 27/25 | 29/605 |
| 2,632,041 | A * | 3/1953 | Bilodeau | H01F 27/306 | 336/182 |
| 2,918,639 | A * | 12/1959 | Beymer | H01F 27/306 | 336/185 |
| 3,307,247 | A * | 3/1967 | Parker | H01F 27/2871 | 29/605 |
| 3,683,495 | A * | 8/1972 | Feather | H01F 27/2871 | 29/605 |
| 4,219,791 | A * | 8/1980 | Moore | H01F 27/323 | 174/120 SR |
| 6,683,524 | B1 * | 1/2004 | Hoglund | H01F 27/25 | 336/212 |
| 8,729,998 | B2 * | 5/2014 | Outten | H01F 27/245 | 336/15 |

* cited by examiner

COIL STRUCTURE OF OPEN VENTILATED TYPE STEREOSCOPIC WOUND-CORE DRY-TYPE TRANSFORMER

CROSS-REFERENCE TO RELATED APPLICATIONS

This Application claims priority to Application 201420417073.6 filed on Jul. 25, 2014 in China.

BACKGROUND

The disclosure relates to the technical field of electrical equipment and particularly relates to a coil structure of an open ventilated type stereoscopic wound-core dry-type transformer.

Currently, according to conventional open ventilated transformer coil structure, a coil needs to be firstly subjected to vacuum drying after completion of winding of the coil, and the dried coil went through vacuum impregnation process in vacuum pressure equipment prior to dripped paint and another drying process so as to ensure the moisture-resistance and electrical performance of the coil; the whole process takes a long time, and a large amount of insulating paint is wasted in the dripped paint process, therefore, the efficiency is low and the production cost is increased.

To solve the technical problems mentioned above, this disclosure provides a coil structure of an open ventilated type stereoscopic wound-core dry-type transformer. It solves the problems of long duration and serious waste of insulating paint in coil paint impregnation process, and greatly improves the production efficiency.

To accomplish purposes mentioned above, the disclosure adopts the following technical scheme:

A coil structure of open ventilated type stereoscopic wound-core dry-type transformer comprises wire disks formed by wound wires and fixing parts; and the fixing parts are provided with clamping grooves for fixing the wire disks; and the wire disks are fixed and wound around the fixing parts to form the coil structure; and the outer layers of the wires are coated with insulating paper with the insulating paint; and by insulating paint, wires are adhered mutually and wire disks adhere to fixing parts, which are combined into one integral structure.

Preferably, clamping grooves on the fixing parts are equally spaced to separate the wire disks so as to form air passages.

Preferably, the fixing parts are made of an insulating material.

Preferably, the coil structure is fixed on an insulating cylinder or the main body of a transformer.

The coil structure of the open ventilated type stereoscopic wound-core dry-type transformer has the beneficial effects that: the wire disks are formed by wound wires coated with insulating paper impregnated with insulating paint, which are fixed by the fixing parts to form the coil structure, and it does not require another paint impregnation process, so the process is simplified; and by insulating paint on the insulating paper, wires are adhered mutually and wire disks adhere to fixing parts so the structure is stable and firm and ensures the electrical equipment meets the requirements of electric performance, mechanical property and insulating property.

BRIEF DESCRIPTION OF DRAWINGS

The embodiments of the disclosure are further described by combining the accompanying drawings.

DETAILED DESCRIPTION

Figure 1:
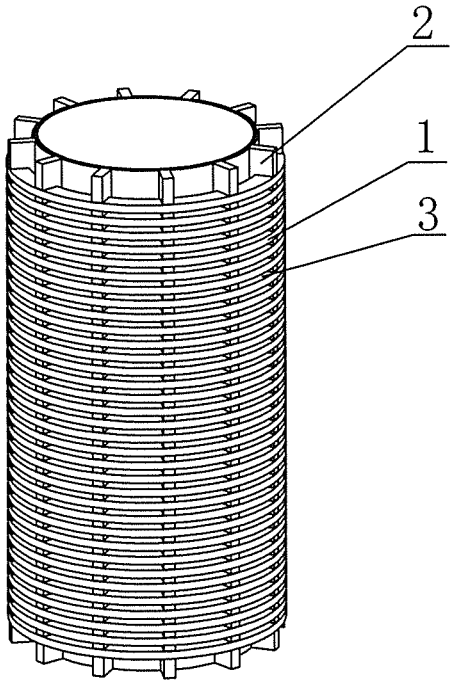
FIG. 1 is a diagram of a coil structure of an embodiment of the disclosure.
Figure 2:
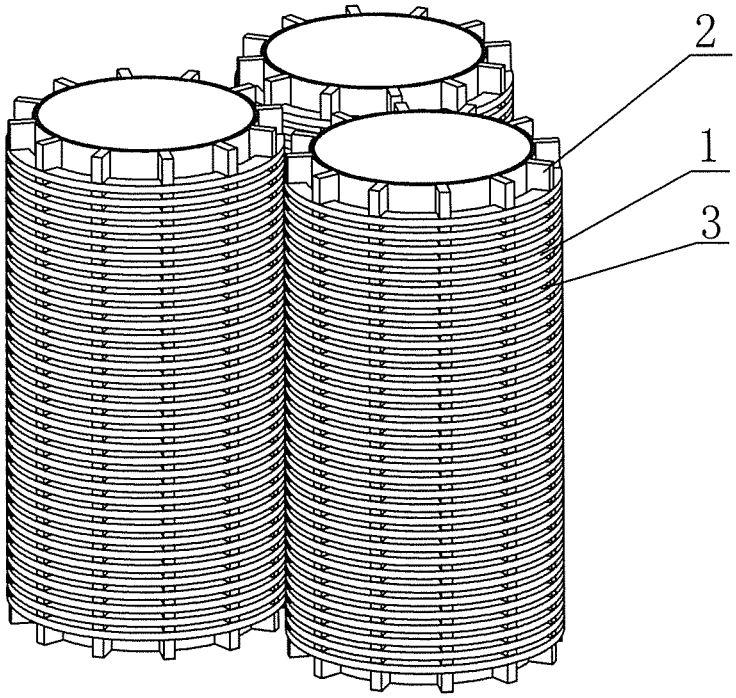
FIG. 2 is a diagram of combination of the coils of the disclosure.

Referring to FIG. 1 and FIG. 2, the disclosure provides a coil structure of open ventilated type stereoscopic wound-core dry-type transformer, comprising wire disks 1 and fixing parts 2. The wire disks 1 are wound by wires whose outer layers are coated with insulating paper. The insulating paper is subjected to dip pretreatment in insulating paint, so the inside and the surface of the insulating paper are impregnated with the required content of insulating paint; and the insulating paper ensures the insulativity between wires. The fixing parts 2 are provided with clamping grooves for fixing the wire disks 1, and the wire disks 1 are fixed and wound around the fixing parts 2 to form the coil structure, and clamping grooves are equally spaced so the wire disks 1 are separated to form air passages 3, which is beneficial to heat dissipation. Meanwhile, the insulating paper also ensures the insulativity between wire disks 1 and fixing parts 2. After the completion of winding of a coil, staying for a required period in certain temperature range, and by insulating paint, wires are adhered mutually and wire disks 1 adhere to fixing parts 2, so the coil structure becomes an integral whole and meets the requirements of electric performance, mechanical property and insulating property. When the coil structure is fixed on insulating cylinders or other parts of the main body of a transformer, it can decrease axial electrodynamic force of the coils. The coils are in triangular structure to form a three-phase coil structure; and the coil structure is suitable for the open ventilated type three-phase dry-type transformer and ensures the transformer meets the requirements of electric performance, mechanical property and insulating property.

The descriptions above are only various embodiments of the disclosure, therefore, the disclosure is not limited to the above structure of the embodiments and any conditions for implementing the technical effects of the disclosure by the same means shall be covered by the disclosure.

What is claimed is:

1. A coil structure of an open ventilated type stereoscopic wound-core dry-type transformer, comprising;

wire disks formed by wound wires and fixing parts, wherein the fixing parts are provided with clamping grooves for fixing the wire disks, wherein the wire disks are fixed and wound around the fixing parts to form the coil structure, wherein the outer layers of the wires are coated with insulating paper with insulating paint; and by way of the insulating paint, the wires are adhered mutually and wire disks adhere to the fixing parts, which are combined into an integral structure, wherein, the insulation paper is soaked in insulation paint firstly, then the wires are wrapped with the insulation paper with insulation paint, finally the coil is wound with the wire, wherein, three coils are in triangular structure to form a three-phase coil structure, and the coil structure is suitable for the open ventilated type three-phase dry-type transformer, wherein, the clamping grooves on the fixing parts are equally spaced to separate the wire disks so as to form air passages, wherein, the fixing parts are made of insulating material, and wherein, the coil structure is fixed on insulating cylinder or the main body of a transformer.

* * * * *